60-372 SR

10/15/85 OR 4,546,607

United States Patent [19]

Kime

[11] Patent Number: 4,546,607

[45] Date of Patent: Oct. 15, 1985

[54] PUMPING APPARATUS

[75] Inventor: James A. Kime, Columbus, Ohio

[73] Assignee: Hydro-Horse, Inc., Columbus, Ohio

[21] Appl. No.: 489,584

[22] Filed: Apr. 28, 1983

Related U.S. Application Data

[63] Continuation-in-part of Ser. No. 209,391, Nov. 24, 1980.

[51] Int. Cl.[4] ..... F16H 39/46

[52] U.S. Cl. ..... 60/372; 60/381; 60/383; 60/414

[58] Field of Search ..... 60/369, 371, 372, 381, 60/383, 414, 446, 452

[56] References Cited

U.S. PATENT DOCUMENTS

| | | | |
|---|---|---|---|
| 2,258,981 | 10/1941 | Ernst | 60/383 X |
| 2,260,175 | 10/1941 | Ernst et al. | 60/383 X |
| 2,560,676 | 7/1951 | White . | |
| 2,564,285 | 8/1951 | Smith . | |
| 2,632,234 | 1/1972 | Lake | 417/390 |
| 2,756,562 | 7/1956 | Deitrickson | 60/414 X |
| 3,058,307 | 10/1962 | Smith | 60/372 |
| 3,939,656 | 2/1976 | Goldfein | 60/381 |
| 4,047,384 | 9/1977 | Saruwartari | 60/372 |
| 4,076,459 | 2/1978 | Adams et al. | 417/217 |
| 4,077,744 | 3/1978 | Pensa | 417/218 |
| 4,114,375 | 9/1978 | Saruwartari | 60/372 |
| 4,187,680 | 2/1980 | Sanford | 60/383 X |
| 4,188,787 | 2/1980 | Bromell | 417/217 X |
| 4,355,506 | 10/1982 | Leonard | 60/452 X |

OTHER PUBLICATIONS

Econo-Pump Corporation Brochure.
Marine and Petroleum Equipment Brochure.
HOE Pump Brochure.
Hydacarbon Mechanicals Brochure.
Pearson Hydraulic Brochure.

*Primary Examiner*—Edward K. Look
*Attorney, Agent, or Firm*—Emch, Schaffer, Schaub & Porcello Co.

[57] ABSTRACT

A pumping apparatus includes a reversible variable displacement drive pump having two ports and a lifting apparatus connected to one of the ports. The lifting apparatus is designed to fit on the well-head of an oil well and attach to the polish rod of the well to operate a down-hole pump. A fluid accumulator containing a precharge is connected to the second port of the drive pump. A pump-off control system automatically adjusts the pumping rate of the lifting apparatus to the individual rate of formation flow of a particular well.

7 Claims, 8 Drawing Figures

13
100
22
25
14
14
20
21
20
21
13
24
26
27
51
10
34
28b
35
36
41
42
38
28
11
53
37
43
39
19
18
15
12
10
40
16
29
47
48
10
10
50
49
10
10
28b
28
10
33
32
32
10
28a
28
31
10
30
54
58
55
56
57
59
10
10
52

PUMPING APPARATUS

BACKGROUND OF THE INVENTION

This application is a continuation-in-part of my presently copending application, Ser. No. 209,391, filed on Nov. 24, 1980.

The present invention relates to an improved pumping apparatus which is an energy recovering hydraulic system, capable of an infinite variety of automatic adjustments to meet optimum pumping efficiency under differing field conditions. The present invention offers an improved pumping apparatus designed to meet some of the many problems associated with the pumping of fluids, particularly oil, which result from continuous variations in the down-hole conditions uniquely associated with each individual well under production.

Rod pumping and the use of a down-hole pump to lift a column of oil out of a well is the most commonplace artificial lift system used in the production of oil. It has been observed with such lift systems that there is a widely accepted policy of sizing the lift mechanism which is used to operate the down-hole pump to provide a greater rate of lift capacity than the rate of flow of oil through the reservoir formation into the well. Under such conditions, the oil is removed from the well at a rate greater than the flow of oil into the well. This results in what is commonly known as a "pumped-off" condition in which a cavity or void forms in the chamber beneath the lifting plunger of the down-hole pump. Such a cavity causes the plunger of the down-hole pump to "pound" on the down stroke as the plunger moves through the void in the chamber with little resistence to a point of contact with either the bottom of the chamber or the oil surface within the chamber. Also, the oil column supported above the plunger will follow the plunger in its downward travel rather than be supported by new oil rising through the traveling ball valve of the plunger as it would if the chamber below the plunger were full of fluid or oil. It can be seen that this "fluid pound" or pumped-off condition can cause extensive damage to the well equipment, including the sucker rod and polish rod, down-hole pump, tubing, stuffing box and, in some cases the surface pumping unit or lift mechanism.

Past efforts to avoid the pumped-off condition and match the capacity of the lift system to reservoir flow productivity have not been fully satisfactory. In some instances, timers have been used to automatically start and stop the pumping system during fixed time periods. These timer systems are not always desirable because they necessitate that the operator have a thorough knowledge of the rate of well production and the amount of pumping time required to maximize each well's production. Also the timer systems are undesirable because they stop the pump and, of course, everytime the pump is stopped, the well is non-productive.

More recent developments utilize automated equipment which involve the detection of fluid pound by comparing specific lifting conditions with a surface parameter. One such automatic device measures the amount of vibration output of the lift system and compares the vibration measurements with indicators representative of standard vibrations of a normally full lift system. Any deviation in vibration which falls outside certain parameters are considered a pumped-off condition and the pump automatically is shut down. Again such down time results in nonproductive use of the well.

Other attempts at pump-off control involve measurement of the load on the polish rod. One variety of such a polish rod load controller incorporates the use of a strain gauge bar which is welded on the walking beam to measure the rod load by way of beam deflection. Another polish rod load controller measures variations in the motor current to measure the load-induced strain on the polish rod. Commonly, these polish rod load controllers will act to shut down the lift system when the strain on the polish rod exceeds specified parameters. Again, these variations of pump-off controls provide a decreased efficiency in well production as they require the lift apparatus to be shut down during pumped-off conditions.

Another commonly encountered impediment to optimum well productivity results from high hydrostatic back pressure which works against formation pressure. The pressure exerted on the oil as it flows from the formation into the well will commonly cause the oil to rise in the well casing to a level high above the formation. In some instances the formation pressure will cause the oil level in the well casing to rise thousands of feet. This high level of oil within the casing of the well produces hydrostatic back pressure which tends to work against the formation pressure which drives the oil into the well, thus slowing the productive rate of the well. Therefore, a full well can be as detrimental to production rates as a well in the pumped-off condition and it is desirable from a production standpoint to closely correlate the pumping rate for the well with the rate of flow of oil from the formation. A reduction in the fluid height in the well, without reaching the pumped-off condition, will provide an increased and optimum flow of oil into the well bore.

SUMMARY OF THE INVENTION

The pumping apparatus of the present invention includes a reversible variable displacement drive pump having two ports and a lifting apparatus in communication with one port of the drive pump. The lifting apparatus is designed to fit on the well-head of an oil well and attach to the polish rod of the well. The lifting apparatus will operate the down-hole pump of the oil well and the stroke length of the lifting apparatus is matched to the stroke length of the down-hole pump. The pumping apparatus also includes a fluid accumulator containing a precharge in communication with the second port of the drive pump. The fluid accumulator applies the precharge to the hydraulic fluid entering the drive pump. During an upstroke of the lifting apparatus the drive pump applies a cumulative pressure to the precharged fluid, thereby creating a working pressure on the precharged fluid sufficient to work against the forces being exerted on the lifting apparatus by the down-hole masses (i.e. the weight of the rod string and plunger, the column of oil and various frictional forces). On the down stroke the force exerted on the lifting apparatus by the down-hole masses, excluding the weight of the column of oil, plus a cumulative pressure applied by the drive pump will operate to drive the hydraulic fluid into the accumulator against the precharge. Thus, an energy-efficient recharging counterbalance is achieved.

The pumping apparatus of the present invention also includes a pilot control system which automatically controls the stroke reversal of the lifting apparatus. As the lifting apparatus causes the polish rod to reach predetermined points of extension and retraction, the pilot control system will automatically direct the drive pump to reverse the flow of fluid between the accumulator and the lifting apparatus.

Under normal pumping conditions, the column of oil above the lifting plunger will be supported by the travelling ball of the plunger and the tubing during the upstroke and the standing ball of the down-hole pump and the tubing during the downstroke. As the lifting plunger begins its downstroke the travelling ball unseats from its valve seat and the oil contained in the chamber of the down-hole pump will flow through the valve opening of the lifting plunger while the oil column is supported on the standing ball.

During a pumped-off condition wherein oil is pumped from the well at a rate faster than the rate of oil flow from the formation into the well bore. A cavity formed in the chamber beneath the lifting plunger of the down-hole pump. The cavity in the chamber of the down-hole pump will be either a void or contain gas. As the plunger begins its downstroke, the void or gas contained in the cavity of the down-hole pump will fail to support the oil column. As the plunger moves downwardly through its stroke, the oil column will remain supported by the travelling ball and move downward through the gas or void with the plunger and travelling ball, rather than be supported by the standing ball. Such a condition increases hydraulic pressure on the rod string and plunger by the weight of the column of oil and results in a concomitant higher working pressure at the lifting apparatus.

To counteract the pumped off condition the present invention further includes a pump-off control system for controlling the displacement of the hydraulic drive pump when the well condition approaches or reaches the pumpedoff stage. The pump-off control system of the present invention measures the pressures created by the forces which are exerted on the lifting apparatus by the down-hole masses at a predetermined point of downward travel which is equivalent to the distance of downward travel needed to eliminate the inherent rod stretch of the rod string. If, at this predetermined point of downward travel, the forces exerted on the lifting apparatus are above a predetermined parameter, the pump-off control system indicating continued support of the oil column during downstroke, will automatically lessen the displacement of the drive pump and slow the rate of movement of the lifting apparatus. Because the rate of movement of the lifting apparatus is slowed, the pumping rate of the down-hole pump will be reduced to a lesser displacement. In this manner, the present invention will automatically adjust the pumping rate of the lifting apparatus to the individual rate of formation flow of a particular well. Thus, the pumping apparatus of the present invention will usually not shut down due to a pumped-off condition, but rather adjust the displacement of the lifting apparatus to alleviate the pumped-off condition. Also, the present invention will substantially eliminate the fluid pound problem which occurs in a pumped-off condition, thereby eliminating many opportunities for costly break-downs of the various components of the lifting apparatus. The present invention provides for more efficient pumping of a specific well, usually resulting in increased productivity since the lifting apparatus is not shutting down for prolonged periods of time.

Thus, it is an object of this invention to provide a pumping apparatus having increased and optimum productivity.

Another object of this invention is to eliminate the fluid pound problems encountered with pumped-off wells.

Another object of this invention is to provide an efficient and less costly pumping apparatus.

Other objects and advantages of the invention will become apparent from the following detailed description with reference being made to the accompanying drawings.

DETAILED DESCRIPTION OF THE PREFERRED EMBODIMENT

Figure 1:
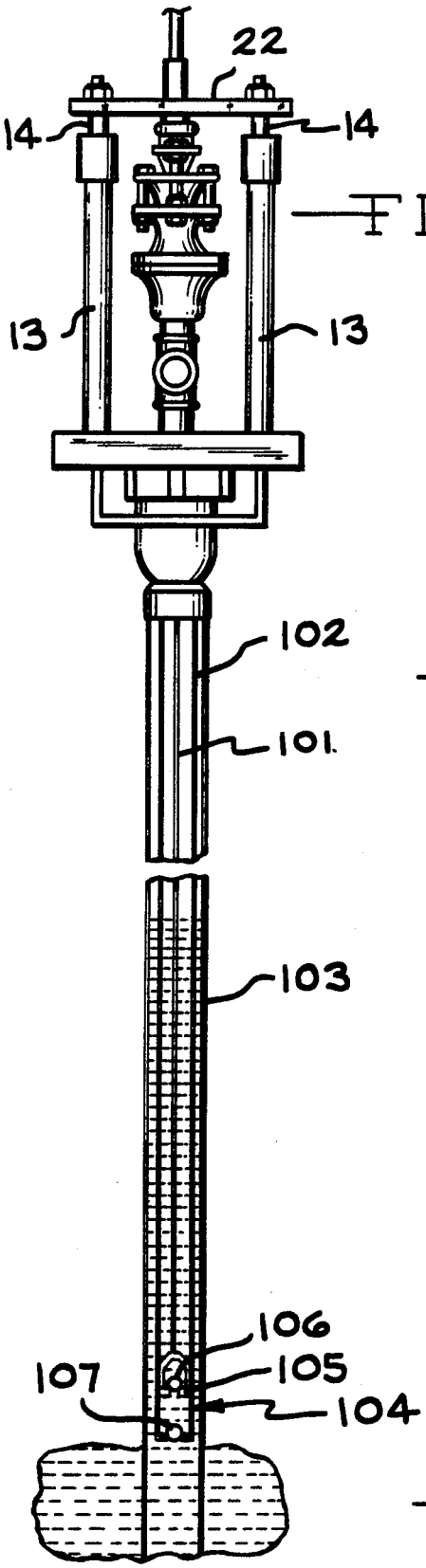
FIG. 1 is a diagrammatic view of the lifting apparatus of the present invention mounted in position on a well having a down-hole pump.

Referring now to FIG. 1, it can be seen that the lifting apparatus of the present invention is mounted on a well-head. The lifting apparatus is connected to the polish rod 100 which extends through the well-head. The polish rod 100 is an extension of the sucker rod 101 which extends downwardly through the tubing 102 contained within the casing 103 of the well. At the bottom of the tubing 102 is a down-hole pump 104 which includes a plunger 105, a travelling ball valve 106 and standing ball valve 107.

Figure 2:
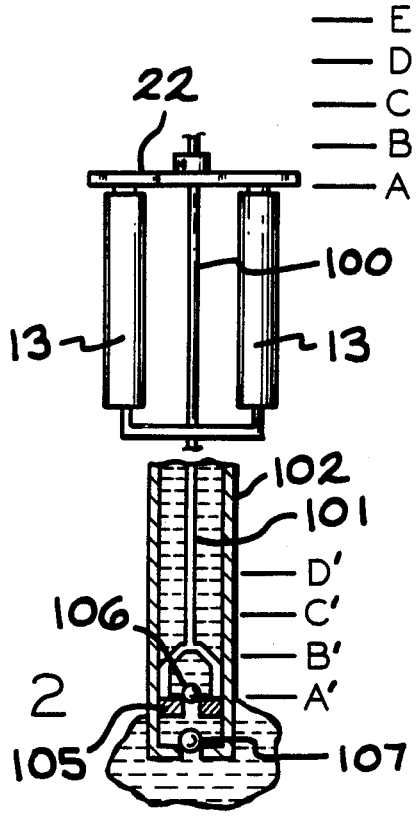
FIG. 2 is a diagrammatic view of the lifting apparatus of the present invention at its lowermost point of travel.

Referring now to FIG. 2, the lifting apparatus and the plunger 105 of the down-hole pump 104 are in a position of rest at their lowermost point of travel. Referring to the travel gradations, the top of the lifting apparatus is at its lowermost point of travel "A" and the plunger 105 is at its lowermost point of travel "A". In this position, the travelling ball valve 106 and standing ball valve 107 are seated in their respective valve seats. The column of oil contained in the tubing 102 above the down-hole pump 104 is being supported by the standing ball valve 107 and the tubing 102. The travelling ball valve 106 and the sucker rod 101 and polish rod 100 (rod string 100, 101) do not receive any forces from the column of oil. The only forces on the rod string 100, 101 at this point in the pump stroke are the weight of the rod string 100, 101 and any frictional forces resulting from stuffing box drag and rod drag on the walls of the tubing 102.

Figure 3:
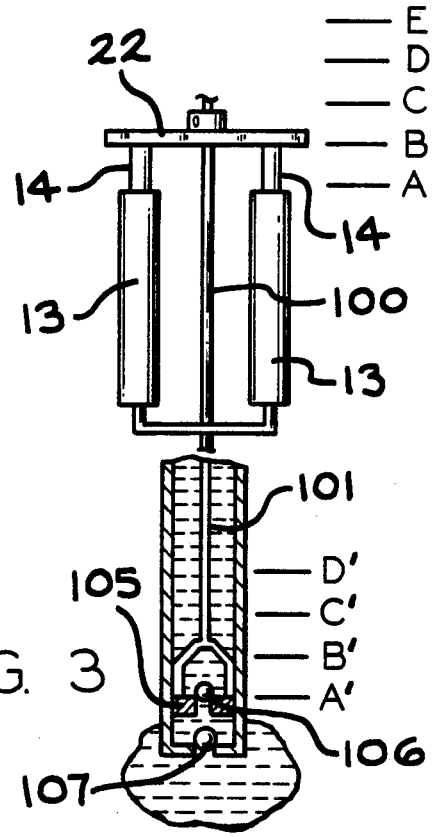
FIG. 3 is a diagrammatic view of the lifting apparatus of the present invention showing the stretch of the rod string as the lifting apparatus begins its upstroke.

Referring now to FIG. 3, the inherent rod stretch experienced at the start of an upstroke is shown. The top of the lifting apparatus has moved upward to a position at travel gradation "B", yet the plunger 105 has not moved and remains positioned at its travel gradation "A". As the lifting apparatus moves upward in its upstroke, support for the weight of the oil column contained in the tubing 102 transfers to the plunger 105, travelling ball valve 106 and rod string 100, 101 thereby increasing the forces on the lifting apparatus to include the rod string 100, 101, frictional forces and the weight of the column of oil.

Figure 4:
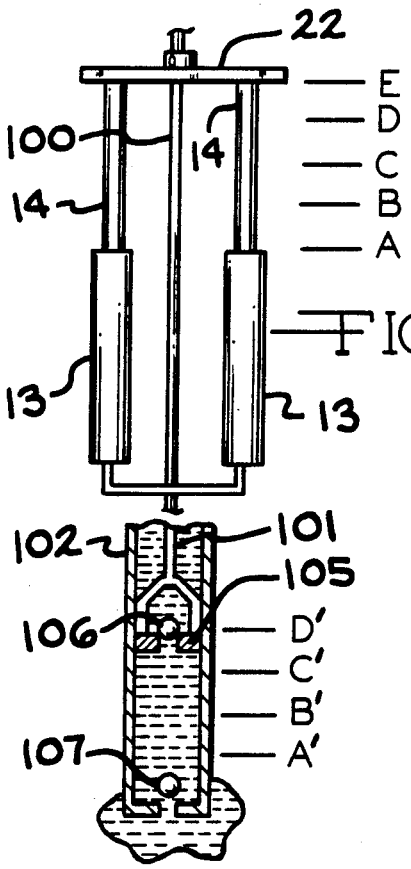
FIG. 4 is a diagrammatic view of the present invention showing the lifting apparatus on the upstroke.

Referring now to FIG. 4, the plunger lift is shown with the lifting apparatus in its fully extended upstroke position "E". The plunger 105 has moved to its fully extended upstroke position "D" and the standing ball 107 has unseated from its valve seat to allow oil under formation pressure to flow into the chamber of the down-hole pump 104 which is located between the plunger 105 and the standing ball valve 107.

Figure 5:
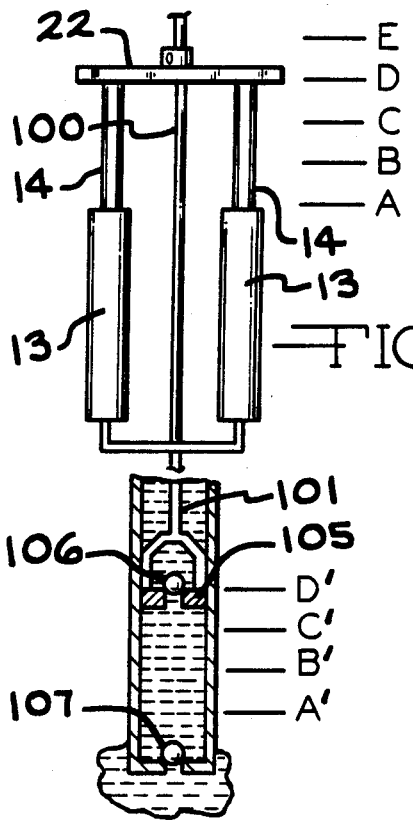
FIG. 5 is a diagrammatic view of the present invention showing the rod string contraction as the lifting apparatus begins its downstroke.

Referring to FIG. 5, the contraction of the rod string 100, 101 is shown as the lifting apparatus begins its downstroke and is positioned at travel gradation "D". The plunger 105 has not yet begun its downstroke and remains at travel gradation "D". During the travel of the lifting apparatus from position "E" to position "D", the fluid pressure in the chamber located between the plunger 105 and the standing ball valve 107 increases as the standing ball valve 107 reseats into its valve seat. The column of oil is once again being supported by the tubing 102 and the standing ball valve 107. The rod string 100, 101 and plunger 105 no longer support the weight of the oil column, thereby significantly decreasing the load on the lifting apparatus. The load on the lifting apparatus is again equivalent, at this point of travel, to the weight of the rod string 100,101 and the frictional forces encountered from stuffing box drag and rod drag on the walls of the tubing 102.

Figure 6:
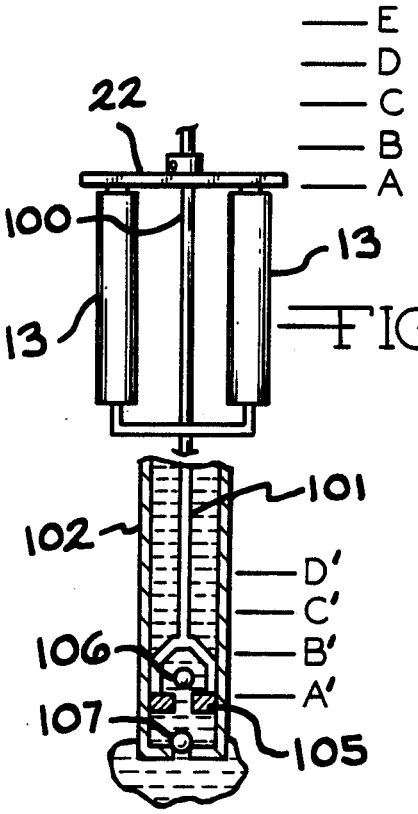
FIG. 6 is a diagrammatic view of the present invention on the downstroke.

Referring now to FIG. 6, the plunger 105 downstroke is shown with the lifting apparatus returned to its lowermost point of travel "A" and the plunger 105 returned to its lowermost point of travel "A". During the downstroke from "D" to "A", the travelling ball 106 has unseated from its valve seat and the plunger 105 has traveled through the oil contained in the chamber of the downhole pump 104 with the oil flowing through the travelling ball 106 valve seat from a position below the plunger 105 to a position above the plunger 105. During the downstroke the weight of the column of oil contained in the tubing 102 remains supported by the tubing 102 and standing ball valve 107. The only forces being experienced at the lifting apparatus are created by the weight of the rod string 100, 101 and the frictional forces caused by rod drag and stuffing box drag. At this point, the normal pumping cycle is completed.

The pumping sequence as shown in FIGS. 2–6 will continue uninterrupted until the formation flow is reduced to a point where the oil cannot flow through the standing ball valve 107 into the chamber of the downhole pump 104 during the upstroke of FIGS. 3 and 4. When this condition occurs, the well is pumped-off and the pump chamber will usually fill with a mixture of gas and oil, or if the well is severely pumped-off, a void will occur in the pump chamber as shown in FIG. 7.

Figure 7:
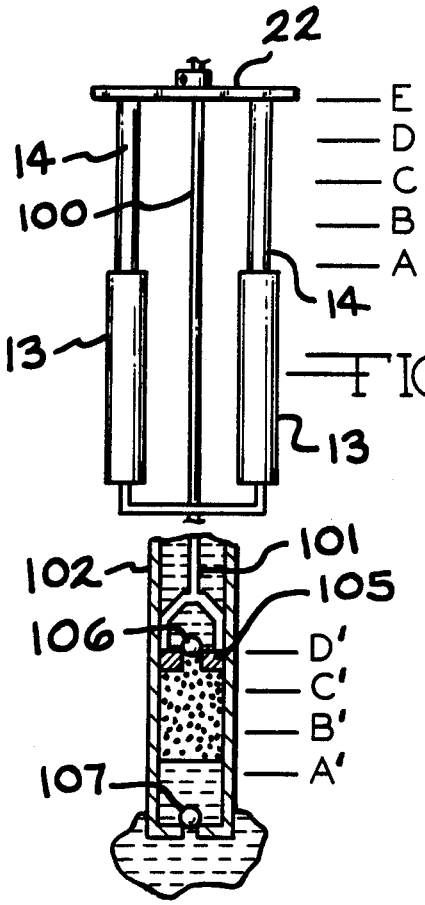
FIG. 7 is a diagrammatic view of the present invention showing a pumpedoff condition.

Referring now to FIG. 7, the position of the lifting apparatus and plunger 105 is shown in the fully extended upstroke. As the lifting apparatus begins its downstroke, the rod contraction of FIG. 5 occurs. However, since the pump chamber under the plunger 105 is a void or contains gas, there is insufficient pressure to support the fluid column as the plunger 105 begins its downstroke. Therefore, during the downstroke through the void or gas, the plunger 105, rod string 100, 101 and travelling ball 106 will continue to support the fluid column, resulting in increased forces on the lifting apparatus. In fact, on many occasions, the plunger 105, rod string 100, 101 and travelling ball 106 and column of oil will fall through the void or gas until contacting the surface of whatever oil is contained in the chamber or the bottom of the pump, frequently resulting in damage to the down-hole pump, rod string 100, 101 and lifting apparatus. To remedy the pumped-off condition, the present invention monitors the load on the rod string 100, 101 and when the forces on the rod string 100, 101, after the downstroke rod contraction occurs, exceed predetermined parameters, the present invention will reduce the stroke speed of the lifting apparatus, thereby allowing the formation flow to catch up with the pumping displacement.

Figure 8:
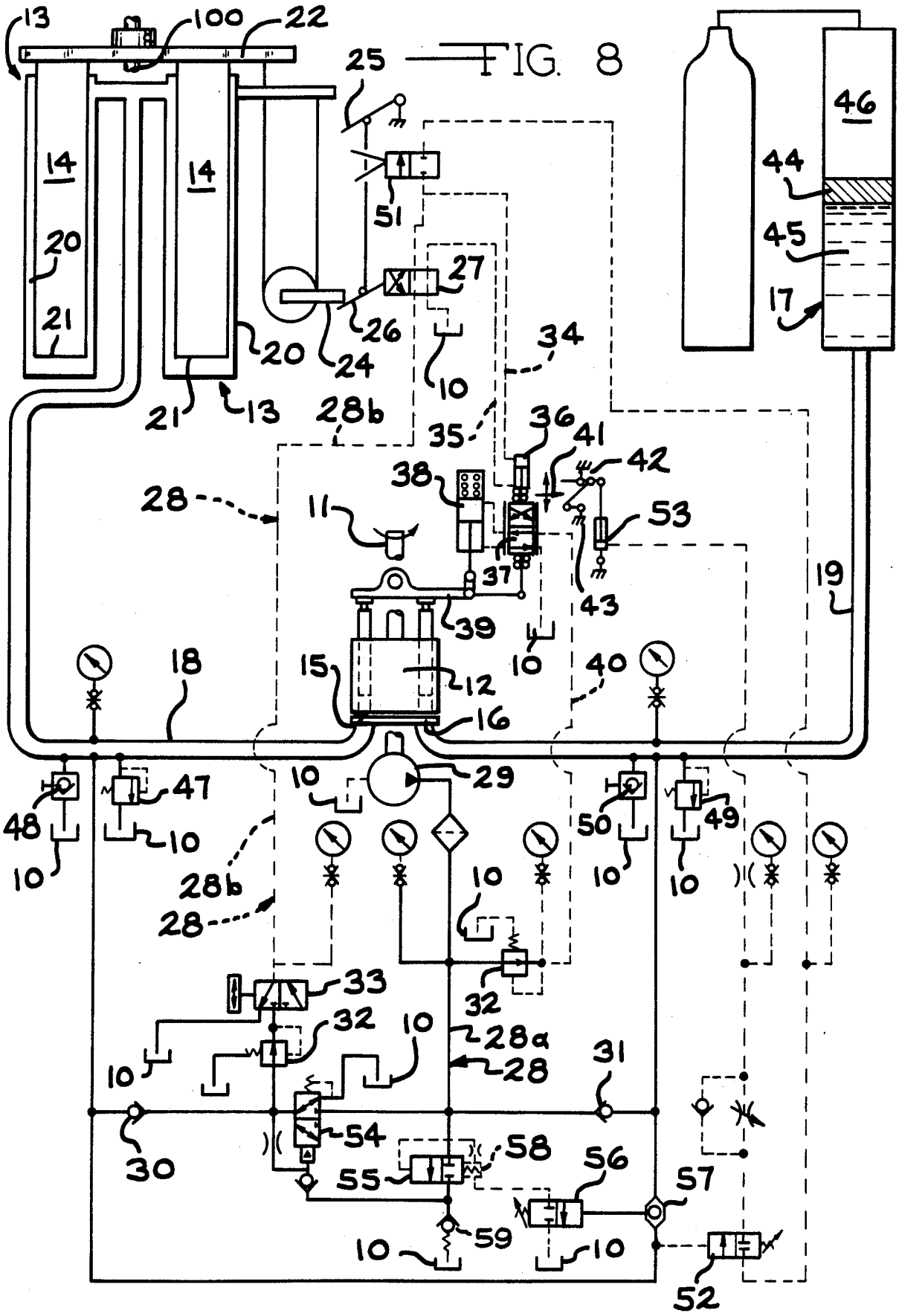
FIG. 8 is a schematic diagram of pumping apparatus including one embodiment of the apparatus according to the present invention.

Referring now to FIG. 8, a schematic of the pumping apparatus of the present invention is shown. The pumping apparatus is designed to balance the forces directed to the drive motor of a reversible, variable displacement hydraulic drive pump so that a relatively small, energy efficient drive motor can be utilized to move large masses contained within an oil well. This unique hydraulic pumping system includes an automatic pilot control system which automatically strokes the lifting apparatus which is attached to the polish rod of the well. This pilot control system includes a unique pump-off control system which causes the pumping apparatus of the present invention to automatically adjust its pumping displacement in response to the changing conditions within the well.

The pumping apparatus includes a fluid reservoir 10 a drive motor 11 and a reversible, variable displacement hydraulic drive pump 12. While a plurality of reservoirs are indicated by the reference number 10, in the present embodiment there is a single fluid reservoir 10. Two interconnected hydraulic pumping cylinders 13, each enclosing a piston 14, are connected to a first port 15 of the hydraulic drive pump 12. A fluid accumulator 17 is operatively connected to a second port 16 of the hydraulic drive pump 12. The fluid accumulator 17 supplies hydraulic fluid under a selected charge pressure to the hydraulic drive pump 12. The hydraulic drive pump 12, increases the pressure of the hydraulic fluid, and directs the fluid under pressure to the hydraulic pumping cylinders 13. The fluid accumulator 17 is precharged to provide the selected charge pressure to the hydraulic fluid and the hydraulic drive pump 12 increases the pressure on the fluid to a pressure necessary to drive the pistons 14 from a first position in a first direction to a second predetermined position.

The first port 15 of the hydraulic drive pump 12 is connected to the hydraulic cylinders 13 by a first main fluid conduit 18. A second main fluid conduit 19 is connected between the second port 16 of the hydraulic drive pump 12 and the pressurized fluid accumulator 17.

In the preferred embodiment, two interconnected hydraulic cylinders 13, which operate in unison, are connected to the first main fluid conduit 18. However, any number of hydraulic cylinders 13 can be used, depending upon the individual design specification needed for a specific well. Each hydraulic cylinder 13 has an outer casing 20 and the first main fluid conduit 18 connects to the outer casing 20 at a point adjacent one end of each hydraulic cylinder 13. The piston 14 is positioned within the outer casing 20. A chamber 21 is defined in the outer casing 20 by one end of the piston 14 and the first main fluid conduit 18 is in communication with the chamber. The opposed end of the piston 14 extends from the top of the hydraulic cylinder 13. The opposed ends of the pistons 14 of the individual hydraulic cylinders 13 are interconnected by a yoke plate 22. This yoke plate 22 is fixed to the polish rod 100 which projects through the stuffing box of the well-head. The polish rod 100 is connected to the sucker rod 101 which extends the length of the well-bore to the down-hole pump 104. As the pistons 14 extend and retract, the yoke plate 22 will likewise cause the polish rod 100 to extend and retract through the stuffing box of the well-head, thus operating the down-hole pump 104.

The interconnected hydraulic cylinders 13 of the present invention are adapted to be fixed directly to the well-head, thereby eliminating installation problems due to uneven or unstable terrain. The operating unit, comprising the hydraulic drive pump, drive motor, reservoir, fluid accumulator, and control systems is attached to the hydraulic cylinders by the first main fluid conduit 18 which is flexible. Therefore, the operating unit may be placed in any position proximate to the well-head and need not be placed in any particular location.

The pilot control system of the present invention includes a control cam 24 which is attached to the yoke plate 22 and extends and retracts as the pistons 14 extend and retract from the outer casing 20 of the hydraulic cylinders 13. A first adjustable control stop 25 and a second adjustable control stop 26 are located adjacent the control cam 24. The first control stop 25 establishes the reversal point of the extension stroke of the pistons 14 and the second control stop 26 establishes the reversal point of the retraction stroke of the pistons 14.

The first adjustable control stop 25 and the second adjustable control stop 26 are in communication with a stroke reverse valve 27. The stroke reverse valve 27 receives pilot fluid through a pilot fluid line 28 which is connected to a hydraulic control pump 29. The hydraulic control pump 29 is operatively connected to the hydraulic drive pump 12. As the first and second adjustable control stops 25, 26 are engaged by the control cam 24, the stroke reverse valve 27 operates to direct pilot fluid to a stroke cylinder 36 for operatively directing the flow of hydraulic fluid through the drive pump 12.

The pilot fluid line 28 is also in communication with the first main fluid conduit 18 through a first check valve 30. The pilot fluid line 28 is also in communication with the second main fluid conduit 19 through a second check valve 31. Should the pressure in either main fluid conduit 18, 19 become less than the pressure in the pilot fluid line 28, the pilot fluid supplied by the hydraulic control pump 29 is diverted through the first check valve 30 or the second check valve 31 into the first main fluid conduit 18 or the second main fluid conduit 19 respectfully to remedy the low pressure problem.

The preferred embodiment of this invention includes a pressure reducing valve 32 is located in the pilot fluid line 28 between the hydraulic control pump 29 and the stroke reverse valve 27. The pressure reducing valve 32 serves to reduce and maintain the fluid pressure in the low pressure portion **28*b* of the pilot fluid line 28 which extends between the pressure reducing valve 32 and the stroke reverse valve 27 to a low pilot pressure of a predetermined level. The high pressure portion 28*a* of the pilot fluid line 28 remains capable of maintaining a broad range of fluid pressures, up to and including the precharge pressure of the accumulator 17. Also included in the low pressure pilot fluid line 28*b*, between the pressure reducing valve 32 and the stroke reverse valve 27 is a manual jog valve 33. The manual jog valve 33 is used to block the flow of pilot fluid from the hydraulic control pump 29 to the stroke reverse valve 27, thereby enabling the operator to manually control movement of the hydraulic cylinders 13**.

The stroke reverse valve 27 is in communication, through a first control line 34 and a second control line 35 with a stroke cylinder 36. The stroke cylinder 36 is operatively connected to servo valve 37 and servo cylinder 38 which operate a control lever 39 of the hydraulic drive pump 12. The control lever 39 is operatively fixed to the swash plate (not shown) within the hydraulic drive pump 12. In the preferred embodiment of this invention the stroke cylinder 36 is biased to place the control lever 39 and swash plate in a neutral position unless pilot fluid is received by the stroke cylinder 36. The servo valve 37 and servo cylinder 38 are also in communication with the high pressure pilot fluid line **28*a* at a point adjacent the hydraulic control pump through a servo fluid line 40. The hydraulic control pump 29 supplies fluid to the servo valve 37 and servo cylinder 38 through the servo fluid line 40. Again, a pressure reducing valve 32 is employed in the servo fluid line 40 to reduce the pilot fluid pressure received from the high pressure pilot fluid line 28*a* to a predetermined lower pressure for operating the servo valve 37 and servo cylinder 38**.

A stroke control arm 41 is operatively attached to the stroke cylinder 36 to move with the stroke cylinder 36 and engage a first stroke stop 42 and a second stroke stop 43. The distance between the first stroke stop 42 and the second stroke stop 43 is adjustable, thereby limiting the distance traveled by the stroke cylinder 36, resulting ultimately in adjustable limitations being placed on the movement of the control lever 39 of the hydraulic drive pump 12 and, thereby, controlling the displacement of the drive pump 12.

As the control cam 24 extends and retracts with the pistons 14 of the hydraulic cylinders 13, the control cam 24 engages the first adjustable control stop 25 and the second adjustable control stop 26. As the control cam 24 engages the first adjustable control stop 25, the pistons 14 of the hydraulic cylinders 13 are in the fully extended position. The control cam 24, in this position, will cause the stroke reverse valve 27 to direct pilot fluid into the first control line 34 causing the stroke cylinder 36, servo valve 37, and servo cylinder 38 to move the control lever 39 of the hydraulic drive pump 12, thereby tilting the swash plate of the hydraulic drive pump 12 to reverse the flow of hydraulic fluid through the hydraulic drive pump 12. As the hydraulic fluid flows from the hydraulic cylinders 13 to the fluid accumulator 17, the pistons 14 will retract under the weight of the down-hole masses, excluding the weight of the column of oil. When the pistons 14 are in the fully retracted position, the control cam 24 will strike the second adjustable control stop 26 causing the stroke reverse valve 27 to direct pilot fluid into the second control line 35. As the stroke cylinder 36 receives pilot fluid from the second control line 35 it commands the servo valve. 37 and servo cylinder 38 to displace the control lever and tilt the swash plate of the hydraulic drive pump 12 to again reverse the flow of the hydraulic fluid, thereby causing the fluid to flow to the hydraulic cylinders 13 from the fluid accumulator 17. The flow of fluid to the hydraulic cylinders 13 causes the pistons 14 to extend, thus completing one cycle of the pumping operation.

The fluid accumulator 17 has a movable barrier 44 which creates a fluid chamber 45 and a gas chamber 46. The gas chamber 46 is precharged, for example by means of a nitrogen cartridge, to a preselected charge pressure approximately equaling the pressure created by the inertial weight of the downhole masses acting on the piston 14 surface area of the hydraulic cylinders 13. As the hydraulic drive pump 12 and drive motor 11 are operated to extend the pistons 14 of the hydraulic cylinders 13, the precharged fluid in the fluid accumulator 17 will provide assistance. The charge pressure of the fluid created by the precharge in the fluid accumulator is increased as the fluid is driven by the hydraulic drive pump 12. This increased fluid pressure works on the piston 14 surface area to overcome the inertial forces of the rod string 100, 101 and the weight of the column of crude oil to drive the pistons 14 to the extended position and operate the down-hole pump 104. This unique counterbalance system results in an energy efficient design that allows a low energy, small drive, motor to operate the pumping circuit and hydraulic pumping cylinder under very high pressures.

The first main fluid conduit 18 includes a first safety release valve 47 which discharges the fluid under pressure to the fluid reservoir 10 should the pressure between the hydraulic drive pump 12 and the hydraulic cylinders 13 exceed a predetermined level. A first dump valve 48 is also included in the first main fluid conduit 18 to enable the operator to manually dump the fluid under pressure in the first main conduit 18 between the hydraulic drive pump 12 and the hydraulic cylinders 13. Likewise, a second safety release valve 49 is located in the second main fluid conduit 19 between the fluid accumulator 17 and the hydraulic drive pump 12. The safety relief valve 49 will discharge the fluid under pressure to the fluid reservoir 10 should the pressure between the hydraulic drive pump 12 and the fluid accumulator 17 exceed a predetermined level. A second dump valve 50 is also located in the second main fluid conduit 19 to enable the operator to manually dump the fluid contained in the second main fluid conduit 19 if desired.

The pump-off control system of the present invention is incorporated into the pilot control system. The pump-off control system controls the displacement of the hydraulic drive pump 12 when the down-hole well condition approaches or reaches a pumped-off condition. A down-hole pump reference valve 51 is located for engagement with the control cam 24 as the pistons 14 are in their retraction stroke after reaching their full extension. The down-hole pump reference valve 51 is positioned at a point of travel in the retraction stroke of the pistons 14 which closely approximates the release of all rod string 100, 101 stretch. As the pistons 14 extend upwardly, pulling the rod string 100, 101 in an upward stroke, the rod string 100, 101 will inherently stretch as it lifts its own mass and the full mass of the column of crude oil above it and works against the frictional forces exerted against the upward movement of all the mass by the tubing 102. When the pistons 14 reach their full extension and the stroke is reversed by the control cam 24 engaging the first adjustable control stop 25, the stretch which occurred in the upstroke of the rod string 100, 101 will be released as the rod string 100, 101 is stroked downwardly. The down-hole pump reference valve 51 is located to engage the control cam 24 at a point where all rod stretch has been released. At this point in travel, the pump-off control system will receive an accurate reading as to the forces being exerted on the rod string 100, 101 by the down-hole masses.

The down-hole pump reference valve 51 is in communication with the first control line 34 and receives pilot fluid from the first control line 34 when the pistons 14 are in their retraction stroke. As the control cam 24 engages the down-hole pump reference valve 51, the down-hole pump reference valve 51 directs the pilot fluid to a pump-off sequencing valve 52 which is in communication with the first main fluid conduit 18. The pump-off sequencing valve 52 is set at a predetermined pressure level so that when the pressure in the first main fluid conduit 18 reaches this predetermined level the pump-off sequencing valve opens directing the pilot fluid received from the down-hole reference valve 51 to a pump-off cylinder 53. The pump-off cylinder 53 is operatively attached to the first and second control stops 42, 43. As the pumpoff cylinder 53 receives pilot fluid from the pump-off sequencing valve 52, it adjusts the first stroke stop 42 and the second stroke stop 43 so as to limit the displacement of the hydraulic drive pump 12. As the hydraulic drive pump displacement slows, the rate of extension and retraction of the pistons 14 slows, thereby slowing the pumping rate of the down-hole pump 104. In this manner, the pumped-off condition is alleviated by allowing the formation flow to catch up with the pumping rate of the pumping apparatus.

The pumping apparatus of the present invention further incorporates a unique cold start up system to prevent cavitation of the hydraulic drive pump 12 upon start up. In most applications, the hydraulic drive pump 12 will leak fluid when exposed to high pressure from the first main fluid conduit 18 or the second main fluid conduit 19. This leakage will occur, with or without the drive motor 11 running, as long as there is pressurized fluid in the first 18 or second 19 main fluid conduits. Therefore, after the drive motor 11 has been shut off, the high pressure hydraulic fluid stored in the fluid accumulator 17 will leak off until the precharged gas chamber 46 is fully extended and there is no more hydraulic fluid under pressure in the fluid accumulator 17 or the second main fluid conduit 19. Likewise, the pistons 14 of the hydraulic cylinders 13 will slowly retract due to the constant forces exerted by the weight of the down-hole masses, thereby causing the hydraulic fluid in the first main fluid conduit 18 and the hydraulic cylinders 13 to leak from the hydraulic drive pump 12. Eventually the pressures in the first 18 and second 19 main fluid conduits will become negligible. Because the pistons 14 of the hydraulic cylinder 13 are fully retracted, the stroke reverse valve 27 will be in position to direct pilot fluid to displace the control lever 39 of the hydraulic drive pump 12 to cause the hydraulic fluid to flow to the hydraulic cylinders 13 and extend the pistons 14. However, the pilot fluid under pressure in pilot fluid lines **28*a* and 28*b* has also leaked off and, as a result, on a cold start up the stroke cylinder 36 will be biased to maintain the control lever 39 and swash plate in a neutral position so the hydraulic drive pump 12** idles.

On start up, the drive motor 11 does not have sufficient power to extend the pistons 14 of the hydraulic cylinders 13 and lift the weight of the down-hole masses at the normal pumping rate. The counterbalance pressure from the precharged fluid accumulator 17 and the second main fluid conduit 19 is negligible since the hydraulic fluid has leaked away during shut down. Without the hydraulic fluid under pressure from the fluid accumulator 17 the hydraulic drive pump 12 will cavitate upon start up at full pumping displacement. To facilitate cold start up, the start up valve 54 is biased closed at low pressure so that it blocks the flow of pilot fluid to the stroke reverse valve 27 at the time of start up. Since the fluid pressure in the low pressure pilot fluid line **28*b* is negligible due to the pilot fluid leaking off during shutdown, the hydraulic drive pump 12 will remain at idle on initial startup. A differential pressure valve 55 is in communication with the high pressure pilot fluid line 28*a* and the start up valve 54. During normal operation the differential pressure valve 55 will be open to dump excess fluid received from the hydraulic control pump 29 through check valve 59. However, on start up, the differential pressure valve 55 is also biased closed thereby blocking the pilot fluid from flowing to the check valve 59 or through start up valve 54. Also in communication with the differential pressure valve 55 is a pressure unloading valve 56. The pressure unloading valve 56 opens and closes at a predetermined pressure to maintain a proper pressure bias at the differential pressure valve 55. On the start up the pressure unloading valve 56 is biased closed, along with the differential pressure valve 55 and start up valve 54**.

On start up, the pilot fluid being pumped by the hydraulic control pump 29 cannot flow to the stroke reverse valve 27 because the start up valve 54 is closed, and since the pilot fluid cannot unload to the fluid reservoir since the pressure unloading valve 56 and differential pressure valve 55 are closed, the pressure in the high pressure pilot fluid line **28*a* will become greater than the pressure in the second main fluid conduit 19. Because of the low pressure in the second main fluid conduit 19 and the concomitant higher pressure in the high pressure pilot fluid line 28*a* during start up, the second check valve 31 will open directing fluid from the high pressure pilot fluid line 28*a* into the second main fluid conduit 19 to begin charging of the accumulator 17. The hydraulic control pump 29 will displace its entire volume of pumped fluid into the second main fluid conduit 19 to charge the accumulator 17. As the second main fluid conduit 19 and the accumulator 17 pressurizes to the desired pressure, shuttle valve 57 will move to a position in which the pressure unloading valve 56 will receive fluid under pressure from the second main fluid conduit 19. As the pressure in conduit 19 increases, the pressure unloading valve 56 will initially open at a predetermined pressure, usually the desired accumulator 17 fluid pressure. As the pressure unloading valve 56 opens, the spring portion 58 of the differential pressure valve 55 will dump the fluid retained under pressure in the spring portion 58 of the differential pressure valve 55 thereby causing the differential pressure valve 55 to shift open when the fluid pressure exerted against the differential pressure valve exceeds a predetermined spring pressure of the spring portion 58. As the differential pressure valve 55 opens, it supplies fluid under pressure to the start up valve 54, causing the start up valve 54 to open, sending fluid through the low pressure pilot fluid line 28b to activate the stroke reverse valve 27 and stroke cylinder 36. Once the start up valve 54 is open and the pumping apparatus is in normal operation, the differential pressure valve 55 will return to its normal function of dumping excess pilot fluid through check valve 59**.

It will be appreciated that other arrangements of the pumping apparatus can be used and that changes may be made in the elements of the pumping apparatus without departing from the scope of the following claims.

What I claim is:

1. A pumping apparatus for use in pumping a viscous mass from a well having a down-hole pump, sucker rod and polish rod extending through a well-head fixture comprising, in combination:

a lifting means for operating such down-hole pump, said lifting means being mounted on such well-head fixture, wherein said lifting means includes at least two hydraulic cylinders, each of said hydraulic cylinders including a piston means, said individual piston means of said hydraulic cylinders being operatively connected to such polish rod;

a first pumping means having first and second ports, said first pumping means being in communication with said lifting means at said first port;

an accumulator means containing fluid under a predetermined precharge pressure in communication with said first pumping means at said second port, wherein said first pumping means receives such precharged fluid from said accumulator and pumps such fluid to said lifting means adding a cumulative pressure to such precharge pressure to create a working force on such fluid, whereby said connection piston means are driven by such fluid under a working pressure to move such polish rod; and a pump-off control means in communication with said lifting means and said first pumping means including a pilot control means for controlling the direction of fluid flow through said first pumping means, said pilot control means including a stroke reverse means in communication with said lifting means and a stroke reverse servo apparatus in communication with said stroke reverse means for directing said first pumping means to move said piston means from a first predetermined position to a second predetermined position by pumping fluid under pressure from said accumulator means to said lifting means, said pilot control means further directing said first pumping means through said stroke reverse means and said stroke reverse servo apparatus to reverse the flow of the fluid when said piston means reaches such second predetermined position, whereby said piston means move from such second predetermined position to such first position as said first pumping means directs such fluid under pressure from said lifting means to said accumulator means, said pump-off control means further including a down-hole referencing means in communication with said lifting means and said pilot control means and a pump-off sequencing valve in communication with said down-hole referencing means, said down-hole referencing means directing said pump-off sequencing valve to become operative only when said pilot control means is directing said first pumping means to pump the fluid under pressure from said lifting means to said accumulator means and said piston means reach a specific location as said piston means are moving from such second predetermined position to such first predetermined position, wherein said pump-off sequencing valve regulates the extent of the displacement of said first pumping means in response to variations in the forces exerted on said lifting means by the down-hole masses.

2. The pumping apparatus of claim 1, wherein said pump-off sequencing valve is in communication with said first port of said first pumping means, said pump-off sequencing valve sensing the pressure applied by the downhole masses on said piston means and regulating the extent of the displacement of said first pumping means in response to the pressure applied by the downhole masses on said piston means.

3. The pumping apparatus of claim 2, wherein said pump-off control means further includes a second pumping means operatively connected to said first pumping means for supplying fluid under pressure to said pump-off control means and said pilot control means.

4. The pumping apparatus of claim 3, wherein said second pumping means also supplies fluid to said first port or said second port of said pumping means when the fluid flow to said first pumping means from said lifting means or accumulator means respectively in reduced to a level that said first pumping means tends to cavitate, whereby the fluid received from said second pumping means prevents said first pumping means from cavitating.

5. The pumping apparatus of claim 4 wherein said pilot control means further includes a start up means for disengaging and first pumping means from operation when such precharge pressure of said accumulator is less than such predetermined pressure, directing such fluid from said second pumping means to said accumulator means to increase the fluid pressure in said accumulator means to such predetermined pressure, and engaging said first pumping means after said accumulator means achieves such predetermined precharge pressure to pump said fluid under such precharge pressure to said lifting means.

6. The pumping apparatus of claim 5, including a first release means for eliminating fluid from said accumulator means and maintaining such precharge pressure.

7. The pumping apparatus of claim 6, including a safety release means for eliminating fluid from said lifting means when the pressure level between said lifting means and said first pumping means exceeds a predetermined level.

* * * * *